US007947166B2

(12) United States Patent
Picard et al.

(10) Patent No.: US 7,947,166 B2
(45) Date of Patent: May 24, 2011

(54) METHOD FOR DESULFURIZING HYDROCARBON FRACTIONS FROM STEAM CRACKING EFFLUENTS

(75) Inventors: Florent Picard, Bretteville du Grand Cause (FR); Quentin Debuisschert, Rueil Malmaison (FR); Annick Pucci, Croissy-sur-Seine (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 532 days.

(21) Appl. No.: 12/047,631

(22) Filed: Mar. 13, 2008

(65) Prior Publication Data

US 2008/0223753 A1 Sep. 18, 2008

(30) Foreign Application Priority Data

Mar. 14, 2007 (FR) ..... 07 01896

(51) Int. Cl.
*C10G 45/00* (2006.01)

(52) U.S. Cl. ..... 208/208 R; 208/57; 208/219; 208/221; 208/223; 208/224; 208/140

(58) Field of Classification Search ..... 208/57, 208/208 R, 219, 221, 223, 224, 140
See application file for complete search history.

(56) References Cited

U.S. PATENT DOCUMENTS 2,846,464 A * 8/1958 Brodkey et al. ..... 560/98
3,271,297 A 9/1966 Krönig et al.
3,689,401 A 9/1972 Gomi et al.
3,838,039 A * 9/1974 Vesely ..... 208/140
6,048,451 A 4/2000 Huff, Jr. et al.
6,059,962 A * 5/2000 Alexander et al. ..... 208/208 R
6,979,394 B2 * 12/2005 Bozzano et al. ..... 208/262.1
2003/0034276 A1 2/2003 Pradhan et al.
2005/0230286 A1 * 10/2005 Briot et al. ..... 208/208 R

FOREIGN PATENT DOCUMENTS

FR 2 858 981 A1 2/2005

* cited by examiner

*Primary Examiner* — Glenn A Caldarola
*Assistant Examiner* — Michelle L Stein
(74) *Attorney, Agent, or Firm* — Millen, White, Zelano & Branigan, P.C.

(57) ABSTRACT

The present invention relates to a method for treating a feed corresponding to a pyrolysis gasoline, comprising:

a) at least one stage of selective hydrogenation of the feed, referred to as HD1, b) fractionating in one or more distillation columns the effluent from stage a) in order to produce at least one light C5 cut, an intermediate C6 or C6-C7 or C6-C8 cut intended for aromatics production, a heavy C7+ or C8+ or C9+ cut intended for gasoline production, c) at least one stage of hydrodesulfurization and deep hydrogenation of the intermediate cut, referred to as HD2, d) at least one stage of alkylation of the heavy C7+, C8+ or C9+ cut consisting of a treatment on an acid catalyst allowing weighting of the sulfur compounds, e) at least one stage of distillation of the effluent from stage d), intended to produce a light fraction that can be directly used as a low-sulfur gasoline base, and a heavy C11+ or C12+ fraction rich in sulfur compounds, used as middle distillate or fuel oil.

14 Claims, 2 Drawing Sheets

METHOD FOR DESULFURIZING HYDROCARBON FRACTIONS FROM STEAM CRACKING EFFLUENTS

This application which claims the priority of French application Ser. No. 07/01896, filed Mar. 14, 2007.

FIELD OF THE INVENTION

The present invention relates to a method for treating hydrocarbon steam cracking effluents. The steam cracking process is a known petrochemical process at the root of the production of the building-block chemicals, in particular ethylene and propylene. Steam cracking produces, apart from ethylene and propylene, large amounts of less valorizable coproducts, notably aromatic pyrolysis gasoline that is obtained in significant proportions when cracking propane or butane, and even more when cracking naphtha, gas oil or condensates.

BACKGROUND OF THE INVENTION

Raw pyrolysis gasoline is often hydrogenated in two stages, with intermediate fractionation so as to typically produce a C5 cut, various cuts intended to produce aromatic bases and gasoline bases or fuel oil. The existing process layouts generally allow to produce a C6 cut to extract benzene and a C7+ cut or a C6-C7-C8 cut to extract benzene, toluene and xylenes, and a C9+ cut.

By definition, a Cn cut is a cut essentially made up of hydrocarbons with n carbon atoms. A Cn+ cut is a cut essentially made up of hydrocarbons with at least n carbon atoms, up to hydrocarbons with 12 carbon atoms. This cut can generally comprise C13, or even C14 hydrocarbons. For example, a C8+ cut essentially comprises C8, C9, C10, C11, C12 hydrocarbons, and this cut can generally comprise C13, or even C14 hydrocarbons.

The C5 cut is generally recycled to the steam cracker or sent to the gasoline pool. The C6-C7-C8 cut, referred to as C6-C8 hereafter, essentially made up of hydrocarbons with 6, 7 or 8 carbon atoms, is used as the base for the production of aromatics (benzene, toluene and xylenes). The C9+ cut is generally used either as furnace fuel oil or as automotive gasoline base. In the latter case, it is generally necessary to separate the heavy fraction corresponding to an ASTM boiling point temperature above 220° C. from the C9-200° C. cut used as a gasoline base compatible with the gasoline cut points.

Besides, pyrolysis gasolines have high sulfur contents, notably the C9+ cut is often above the current (50 to 150 ppm weight) or future specifications. In fact, these gasolines contain about 300 ppm weight of sulfur, as well as high reactive unsaturated compound contents, which makes them unusable without an additional treatment.

The C6 or C6-C7 or C6-C8 fractions intended for the production of aromatic bases are treated in a dedienization stage (selective hydrogenation) in order to remove the reactive unsaturated compounds such as diolefins, acetylenic compounds and alkenyl aromatics, then in a hydrodesulfurization stage in order to remove the mono-olefins and the sulfur compounds, without however hydrogenating the aromatic compounds. Alkenyl aromatics are hydrocarbon-containing compounds consisting of at least one aromatic ring comprising at least one alkenyl group.

The C7+ or C8+ or C9+ fractions intended for the production of gasolines are often treated in a dedienization stage, then used directly as a gasoline base possibly after a fractionating stage to remove the C11+ or C12+ compounds and to obtain the end point specification for the gasoline. However, their sulfur content becomes incompatible with the evolution of the standards relative to the maximum sulfur content of gasolines that tend to fall below 50 ppm, or 30 ppm, or even 10 ppm weight.

Three options are currently used or considered for meeting this situation, in particular for existing steam crackers.

1) Option 1 consists in modifying the existing hydrotreating plants so as to significantly increase their capacity and desulfurization. There are suitable desulfurization catalysts, the most commonly used ones being mainly catalysts based on nickel and molybdenum, or nickel and tungsten or cobalt and molybdenum, on an alumina support.

2) Option 2 consists in adding a new final desulfurization plant for hydrogen treatment of the fraction valorizable to a gasoline cut.

These first two options lead to notable additional investments and hydrogen consumption, a gas that becomes increasingly rare on refining and petrochemistry sites, without any gain as regards valorization of the products that remain gasoline bases of rather poor quality. Furthermore, deep desulfurization is accompanied by a limited reduction in the aromatics content to be minimized, which remains unfavourable for the octane number and therefore for its valorization.

3) Option 3 consists in selling the gasoline fraction as produced to an oil refinery that will achieve final desulfurization. This option leads to a significant depreciation of the price of the gasoline thus sold.

The goal of the invention is to find a technically simple and inexpensive solution to the aforementioned problem in order to produce on a petrochemical site C7+ or C8+ or C9+ fractions from steam cracking plants that can be directly used as gasoline base with a low sulfur content.

The various ways of hydrotreating liquid hydrocarbon fractions from steam cracking plants are described in the literature. An example thereof is patent application FR-2,858,981 that describes a production layout for various cuts from a steam cracking plant using 3 distinct hydrotreating stages.

However, the existing solutions or those considered exclusively consist in carrying out hydrodesulfurization stages that require the presence of hydrogen in a costly process and they do not describe the possibility of treating one of the fractions from the steam cracking plant by means of a process based on weighting the sulfur compounds on an acid catalyst.

Besides, desulfurization of hydrocarbon fractions by treatment on an acid catalyst is also widely described in the literature. For example, U.S. Pat. No. 6,048,451 describes how to desulfurize gasolines from catalytic cracking plants by means of a process consisting in converting the sulfur compounds to heavier sulfur compounds using an alkylation agent in the presence of an acid catalyst. The alkylation agent includes olefins or alcohols. However, this invention is described for an application to catalytic cracking gasolines and it aims to weight sulfur compounds of thiophene and methylthiophene type.

SUMMARY OF THE INVENTION

The present invention relates to a method of treating a feed corresponding to a pyrolysis gasoline, comprising:

a) at least one stage of selective hydrogenation of the feed, referred to as HD1, b) fractionating in one or more distillation columns the effluent from stage a) in order to produce at least one light C5 cut, an intermediate C6 or C6-C7 or C6-C8 cut intended for aromatics production, a heavy C7+ or C8+ or C9+ cut intended for gasoline production, c) at least one stage of hydrodesulfurization and deep hydrogenation of the intermediate cut, referred to as HD2, d) at least one stage of alkylation of the heavy C7+, C8+ or C9+ cut consisting of a treatment on an acid catalyst allowing weighting of the sulfur compounds, e) at least one stage of distillation of the effluent from stage d), intended to produce a light fraction that can be directly used as a low-sulfur gasoline base, and a heavy C11+ or C12+ fraction rich in sulfur compounds, used as middle distillate or fuel oil.

The invention thus allows, while wandering from the conventional technical philosophy that consists in reducing the sulfur content of pyrolysis gasolines by hydrogen treatment, to produce low-sulfur pyrolysis gasolines that can be directly used as gasoline base and having a high octane number. Furthermore, stages a), b), c) and e) as described in the present application often exist in petrochemical complexes equipped with steam cracking plants. The investment required for producing sulfur-depleted pyrolysis gasolines is then low since it only consists in carrying out sulfur compounds weighting stage d).

DETAILED DESCRIPTION

Stage a)

The feed, referred to as pyrolysis gasoline, is obtained from one or more steam cracking gasoline fractionations and it corresponds to a cut whose boiling point temperature generally ranges between 0° C. and 250° C., preferably between 10° C. and 220° C. Typically, this feed essentially consists of C5-C11 with C3, C4, C12, C13, C14 traces (some wt. %).

This feed is generally subjected to selective hydrogenation stage a) and the effluent from stage a) is sent to stage b).

It is possible to use, for this selective hydrogenation stage referred to as HD1, a noble metal catalyst (of palladium type notably, such as the LD265/LD465 catalysts marketed by the Axens Company) or a non-noble metal catalyst (of nickel type for example, such as the LD341/LD441 catalysts marketed by the Axens Company). Stage a) consists in contacting the feed to be treated with hydrogen introduced in excess in one or more reactors containing a hydrogenation catalyst. The hydrogen flow rate is adjusted so as to have a sufficient amount for theoretically hydrogenating all of the diolefins, the acetylenics and the alkenyl aromatics and to maintain a hydrogen excess amount at the reactor outlet. In order to limit the temperature gradient in the reactor, it can be advantageous to recycle a fraction of the effluent to the reactor inlet. Selective hydrogenation stage HD1, also referred to as hydrodedienization stage, is known to the person skilled in the art and it is notably described in Petrochemical Processes, Volume 1, Technip Ed., A. Chauvel and G. Lefebvre, pp. 155-160.

The operating temperature during stage a) generally ranges between 50° C. and 200° C., the hourly space velocity ranges between 1 $h^{-1}$ and 6 $h^{-1}$, and the pressure ranges between 1.0 MPa and 4.0 MPa.

Stage b)

It is a stage of fractionation, in one or more distillation columns, of the feed or of the effluent of stage a) in order to produce at least one light cut essentially consisting of C5, an intermediate cut essentially consisting of C6 or C6-C7 or C6-C8 typically intended for the production of aromatics and a heavy cut essentially consisting of C7+ or C8+ or C9+ typically intended for the production of gasoline.

According to a preferred embodiment of the invention, the feed is subjected to two successive distillations so as to produce the 3 cuts. The first distillation leads to a light cut essentially consisting of C5 and a C6+ cut. The C6+ cut is sent to a second distillation column that leads to an intermediate cut essentially consisting of C6 or C6-C7 or C6-C8 intended for the production of aromatics and a heavy cut essentially consisting of C7+ or C8+ or C9+ intended for the production of gasoline.

According to another embodiment, the feed is first subjected to a first distillation in order to obtain a light cut essentially consisting of C5 and a C6+ cut that is sent to stage a). The effluent from stage a) is then subjected to a distillation so as to obtain an intermediate cut essentially consisting of C6 or C6-C7 or C6-C8 intended for the production of aromatics and a heavy cut essentially consisting of C7+ or C8+ or C9+ intended for the production of gasoline. The intermediate cut is then sent to hydrodesulfurization and deep hydrogenation stage c) while the heavy cut is sent to alkylation stage d). The effluent from alkylation stage d) is then sent to distillation stage e).

Stage c)

It is a stage, referred to as HD2, of hydrodesulfurization and deep hydrogenation of the intermediate cut. Stage c) consists in contacting the intermediate cut to be treated with hydrogen in one or more reactors containing a hydrogenation and hydrodesulfurization catalyst. This stage is also known to the person skilled in the art and it is notably described in Petrochemical Processes, Volume 1, Technip Ed., A. Chauvel and G. Lefebvre, p. 160.

The operating temperature of stage c) generally ranges between 220° C. and 380° C., the hourly space velocity ranges between 1 $h^{-1}$ and 6 $h^{-1}$, and the pressure ranges between 1.0 MPa and 4.0 MPa.

A sequence of LD145 and HR406 catalysts marketed by the Axens Company can for example be used to carry out this stage c).

Stage d)

Alkylation stage d) is a stage for treating the heavy C7+, C8+ or C9+ cut consisting in treating on an acid catalyst allowing to desulfurize the fraction of said cut boiling in gasoline without hydrogen supply, by weighting the sulfur compounds.

According to a preferred embodiment, the feed treated in alkylation stage d) is a hydrocarbon fraction from a steam cracking plant.

According to another preferred mode, the feed corresponds to a C7+, C8+ or C9+ cut pretreated in a hydrogenation plant HD1. Plant HD1 used in stage a) is intended for selective hydrogenation of the diolefins, the acetylenics and a fraction of the alkenyl aromatics. The feed is generally a mixture of olefinic, aromatic, paraffinic and naphthenic compounds, as well as sulfur, in a proportion of 20 ppm weight to 1000 ppm weight.

Alkylation stage d) is carried out in the alkylation section that can comprise one or more reactors.

The main goal of stage d) is to weight the sulfur compounds by addition of mono-olefins present in the feed. The sulfur compounds likely to react are thiophenic compounds of alkylthiophene type, and to a lesser extent mercaptan type compounds. These reactions involve no conversion of the aromatic compounds because these compounds have a much lower reactivity than the olefinic and sulfur compounds, and they therefore are not converted, which is favourable to the octane number maintenance.

Surprisingly, it has been discovered that it is possible to alkylate the alkylthiophenes whose alkyl groups comprise 1 to 4 carbon atoms, notably the alkylthiophenes of ethylthiophene, dimethylthiophene, propylthiophene and butylthiophene type, by means of mono-olefins comprising 7 carbon atoms or more, and alkenyl aromatics. However, the reactivity of long olefins being lower than the reactivity of short olefins, it can be advantageous to mix with the feed a stream containing butenes or pentenes.

Alkylation stage d) generally consists in contacting the fraction to be treated with a solid acid catalyst under flow rate, temperature and pressure conditions selected so as to promote the addition of mono-olefins and alkenyl aromatics to the sulfur compounds. The heavy sulfur compounds thus formed generally have a boiling point temperature that is higher than the typical end point of gasoline, i.e. above 220° C. Typically, they can therefore be separated from gasoline by simple distillation.

The catalyst used in alkylation stage d) is preferably a solid acid catalyst. Any catalyst likely to promote the addition of unsaturated hydrocarbon compounds to sulfur compounds can be used in the present invention. Zeolites, clays, functionalized silicas, silico-aluminates with an acidity or grafted supports of acid functional groups, or acid ion-exchanging resins are generally used.

Preferably, acid ion-exchanging resins are used, more preferably polymeric acid ion-exchanging resins such as sulfonic acid resins. For this application, the resins marketed by the Rhom & Haas Company under the name Amberlyst 15, Amberlyst 35 or Amberlyst 36 can be used. It is also possible to use the TA801 resin marketed by the Axens Company.

It is also possible to use catalysts based on phosphoric acid, as described in U.S. Pat. No. 6,736,963, obtained by comixing phosphoric acid and amorphous silica of kieselguhr type.

Besides supported acids, it is also possible, while remaining within the scope of the invention, to use acids based on inorganic oxides including aluminas, silicas, silica-aluminas, and more particularly zeolites such as the following zeolites: faujasites, mordenites, L, omega, X, Y, beta, ZSM-3, ZSM-4, ZSM-5, ZSM-18 and ZSM-20. The catalysts can also consist of a mixture of various Lewis acids (BF4, BC13, SbF5 and AlCl3 for example) with a non-zeolitic metallic oxide such as silica, alumina or silica-alumina.

The operating temperature is generally adjusted according to the catalyst selected in order to reach the desired sulfur compound conversion ratio. The temperature generally ranges between 30° C. and 300° C., preferably between 40° C. and 250° C.

In the event that the catalyst used is an acid ion-exchanging resin, the temperature does not exceed 200° C. and preferably 150° C. in order to preserve the catalyst integrity.

If the catalyst used is a phosphoric acid on silica, the temperature is above 100° C. and below 250° C., preferably above 140° C. and below 220° C.

The volume of catalyst used is such that the ratio of the volume flow rate of feed to be treated to the catalytic volume, also referred to as hourly space velocity, typically ranges between 0.05 $h^{-1}$ and 5 $h^{-1}$, preferably between 0.07 $h^{-1}$ and 3 $h^{-1}$ and more preferably between 0.1 $h^{-1}$ and 2 $h^{-1}$.

The pressure is generally adjusted in order to keep the reaction mixture in the liquid phase. Typically, the pressure ranges between 1.0 MPa and 4.0 MPa, preferably between 1.5 MPa and 4.0 MPa.

Alkylation stage d) is typically carried out in at least one fixed-bed cylindrical reactor. However, several reactors operated in series or in parallel are preferably used to guarantee continuous operation despite deactivation of the catalyst. According to a preferred embodiment of the invention, the alkylation stage is performed in 2 identical reactors connected to one another, one being in operation while the other is stopped and loaded with fresh catalyst ready for use. This device notably allows to operate the plant continuously during the replacement phases or during the phases of in-situ regeneration of the used catalyst.

According to another embodiment of the invention, the alkylation stage is carried out in 3 reactors that can be operated in parallel or in series. In the latter case, the feed successively supplies two reactors, a first one containing a partly used catalyst and the second containing fresh catalyst. The third reactor is left stationary, loaded with fresh catalyst and ready to be used. When the catalyst of the first reactor is deactivated, the reactor is stopped, the second reactor is then operated in first position and the third reactor, initially stationary, is operated in second position. The stopped first reactor can then be unloaded and its catalyst replaced by a fresh catalyst batch.

In parallel with the sulfur compound alkylation reactions, olefins dimerization reactions may occur in the reactor, involving weighting of the hydrocarbon fraction treated. However, the aromatic type compounds are hardly or even not converted in the reactor. Generally, aromatics conversion is below 10%, preferably below 5%, which allows to preserve the octane number of the cut. The sulfur compound alkylation and olefin dimerization reactions have an exothermic character, i.e. they are favoured at low temperature and they release heat. In order to limit the heat release and not to reach excessive temperatures in the reactor, it can be advantageous to recycle a fraction of the effluent(s) of the reactor(s) to the inlet of the reactor(s). The recycle ratio, defined as the flow rate of recycled effluent divided by the flow rate of fresh feed, typically ranges between 0.2 and 4, preferably between 0.5 and 2.

In the particular case where the catalyst used is an ion-exchanging resin, it can be advantageous to use the catalyst in a so-called expanded bed. The feed is therefore generally injected into the reactor bottom, at a sufficient linear velocity to cause suspension of the catalyst balls. This type of implementation affords the advantage of limiting the temperature gradient in the reactor, i.e. the temperature difference between the outlet and the inlet of the reactor, and of providing good distribution of the liquid hydrocarbon feed and good thermal homogeneity in the reactor.

According to a preferred embodiment, a catalyst addition/withdrawal system can be added to the reactor in order to achieve continuous withdrawal of the used catalyst and to have fresh catalyst makeup.

According to the preferred embodiment of the invention, an acid ion-exchanging resin type catalyst is used because it is a very active catalyst allowing the reactor to be operated at a low temperature, generally below 200° C., which allows to limit the formation of gums and polymers, these products forming readily by condensation reaction of the unsaturated compounds of polyolefin or alkenyl aromatic type in the intermediate steam cracking fractions. Thus, the hourly space velocity (HSV) is adjusted in order to allow operation at the lowest possible temperature compatible with the desired performances. Typically, the reactor can be operated at an hourly space velocity ranging between 0.1 $h^{-1}$ and 2 $h^{-1}$, and at a temperature below 80° C. When the catalyst deactivates, it is necessary to progressively raise the temperature to maintain the performances. The temperature can then be progressively increased until it reaches generally 150° C. or 200° C. maximum.

The used catalyst can be subjected to a rejuvenation treatment either in the reactor when it is isolated from the circuit or outside the reactor when an addition/withdrawal system is provided. According to the type of catalyst used, at least one of the following treatments can be performed:

washing with oxygenated compounds,
washing with aromatic compounds,
gas stripping (nitrogen, hydrogen, steam),
diluted air combustion.

According to a preferred embodiment, a fraction of the light C5 cut is injected into the heavy C7+, C8+ or C9+ cut, then sent to the alkylation stage. This mixture allows to increase the amount of reactive mono-olefins and thus to favour conversion of the sulfur compounds.

Stage e)

It is a stage of distillation of the effluent from stage d), intended to produce a light fraction that can be directly used as a gasoline base, and a heavy C11+ or C12+ fraction rich in sulfur compounds and used as middle distillate or fuel oil. The light fraction has an end point generally below 230° C. and preferably below 220° C.

DESCRIPTION OF THE FIGURES

FIG. 1

Figure 1:
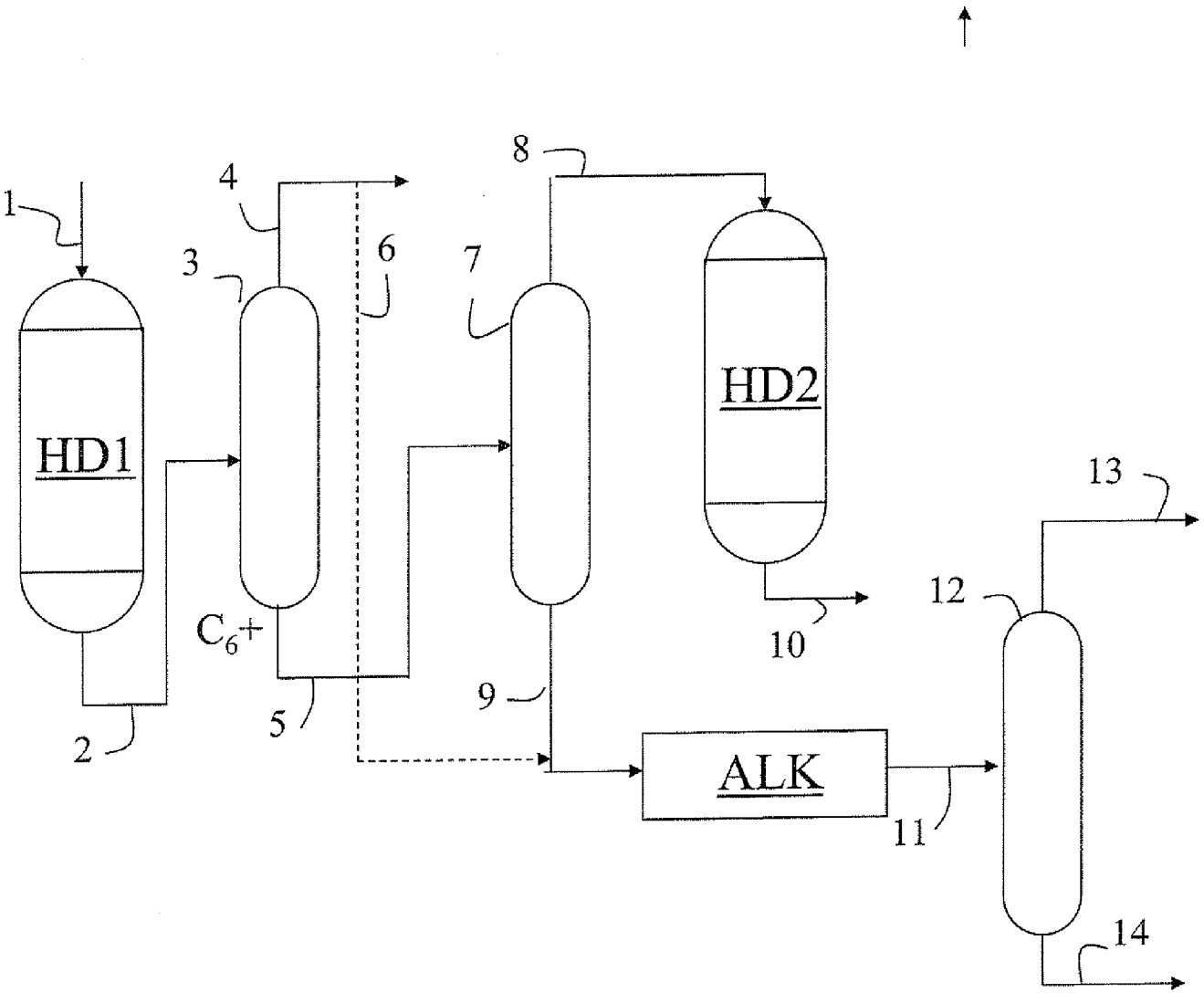
FIGS. 1 and 2 are schematic flowsheets of performed embodiments of the invention with FIG. 2 being directed to step (d) in particular.

FIG. 1 shows a preferred embodiment of the invention. The feed is supplied through line 1 and treated in a selective hydrogenation plant HD1 to achieve notably dedienization and prior reduction of the alkenyl aromatics. The dedienized feed circulates through line 2 and it is fractionated in a distillation column 3 into a C5 fraction circulating through line 4, typically recycled to steam cracking or used as gasoline base, and a 6+ fraction circulating in line 5. This C6+ cut is fractionated in a distillation column 7 into a C6-$C_n$ fraction (where n=7 or 8) circulating in line 8, and a $C_{n+1}$+ fraction circulating in line 9. The C6-$C_n$ cut supplies a hydrotreating plant HD2 that achieves deep desulfurization of the C6-$C_n$ cut and deep hydrogenation of the mono-olefins. The LD145/HR406 catalysts marketed by the Axens Company can for example be used to carry out this stage. The treated C6-$C_n$ cut discharged through line 10 can have, for example, less than 1 ppm weight sulfur and less than 50 ppm weight mono-olefins. One generally tries to minimize hydrogenation of the aromatics in this cut so as to maximize their further recovery for petrochemical applications. The $C_{n+1}$+ cut leaving the bottom of column 7 through line 9 supplies alkylation section ALK in order to produce an alkylated cut recovered through line 11. It is possible to inject a fraction of the C5 cut from column 3 by means of line 6 into the feed of the alkylation section so as to increase the number of reactive olefins and thus to favour the conversion of the sulfur compounds. The cut produced in alkylation section ALK is sent through line 11 to a distillation column 12 so as to produce, at the top, a sulfur-depleted $C_{n+1}$-C12 cut recovered through line 13 and intended to be used as gasoline base and, at the bottom, a C12+ cut recovered through line 14 that can be used as furnace fuel oil and wherein the sulfur compounds alkylated in the alkylation section are concentrated. The $C_{n+1}$-C12 cut recovered through line 13 generally contains less than 100 ppm sulfur, or even less than 50 ppm sulfur or, with a view to the production of very low sulfur gasolines, less than 10 ppm sulfur.

FIG. 2

Figure 2:
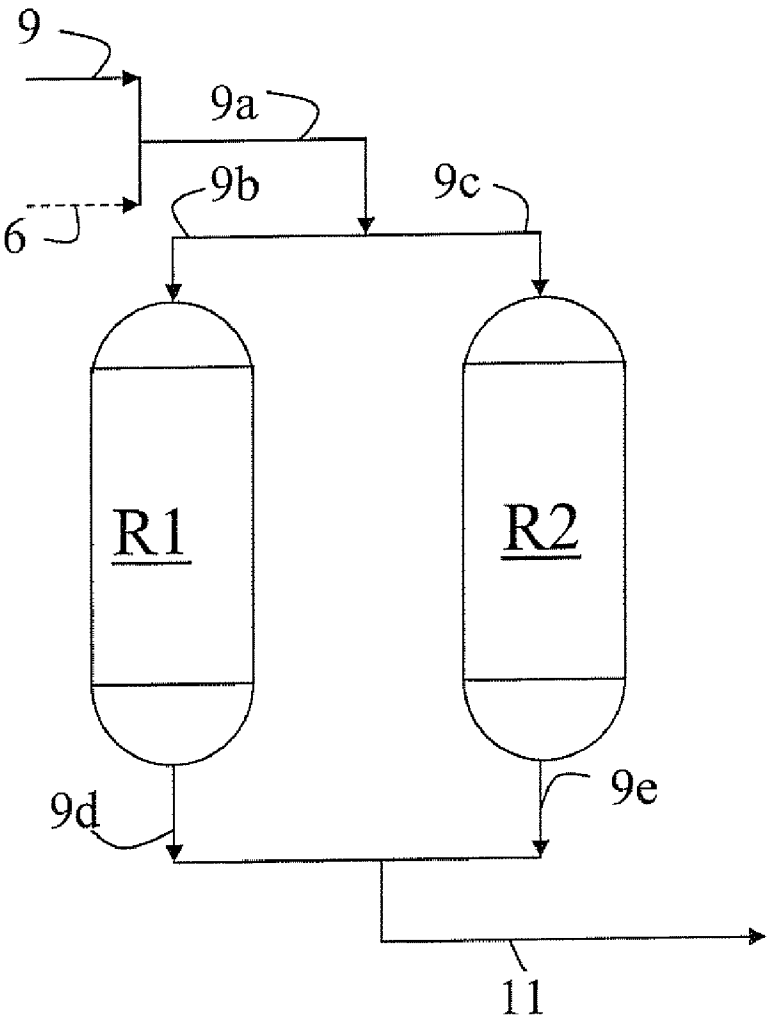

FIG. 2 shows a preferred embodiment of alkylation stage d). The alkylation section consists of two reactors R1 and R2 that can be operated in parallel. The $C_{n+1}$ fraction (where n=7 or 8) recovered from distillation column 7 through line 9 is possibly mixed with a fraction of the C5 cut through line 6. The mixture thus obtained (line 9a) is sent to reactor R1 through line 9b and the alkylation product is recovered through line 9d. During this stage, reactor R2 is loaded with fresh and active catalyst, and it is left stationary. When the catalyst contained in reactor R1 is deactivated, reactor R1 is stopped and the feed to be treated is sent to reactor R2 through line 9c. The alkylation product is recovered through line 9e. Meanwhile, the catalyst contained in reactor R1 is unloaded and replaced by fresh catalyst. This particular device allows to maintain continuous operation even when the catalyst is deactivated.

EXAMPLES

The following example describes in a non limitative way catalysts and operating conditions that can be used in the method according to the invention.

Naphtha steam cracking effluents are fractionated in an effluent treating plant, comprising primary distillation, so as to produce notably a pyrolysis gasoline cut α, comprising essentially C5 and heavier hydrocarbons up to an ASTM end point of 210° C.

This pyrolysis gasoline cut α has the following characteristics:

Sulfur content: 200 ppm weight

Composition of the pyrolysis gasoline cut α (wt. %)

| | C3 | C4 | C5 | C6 | C7 | C8 | C9 | C10 | C11 | C12+ | Total |
|---|---|---|---|---|---|---|---|---|---|---|---|
| n-paraffins | 0.0 | 0.1 | 3.6 | 1.3 | 0.2 | 0.0 | 0.0 | 0.0 | 0.0 | 0.0 | 5.2 |
| i-paraffins | | 0.0 | 2.7 | 1.4 | 0.3 | 0.4 | 0.1 | 0.0 | 0.0 | 0.0 | 4.9 |
| mono-olefins | 0.2 | 0.6 | 5.3 | 1.7 | 0.7 | 1.0 | 0.4 | 0.3 | 1.0 | 0.9 | 12.1 |
| diolefins | 0.0 | 1.1 | 10.3 | 3.9 | | | | 3.4 | 1.8 | 0.1 | 20.8 |
| naphthenes | | | 0.5 | 1.3 | 0.5 | 0.1 | 0.0 | 0.0 | 0.0 | 0.0 | 2.5 |
| aromatics | | | | 26.6 | 11.8 | 4.2 | 2.0 | 1.9 | 0.7 | 0.1 | 47.3 |
| alkenyl aromatics | | | | | | 3.5 | 3.1 | 0.5 | 0.0 | 0.0 | 7.1 |
| Total | 0.2 | 1.8 | 22.4 | 36.4 | 13.5 | 9.2 | 5.6 | 6.2 | 3.6 | 1.1 | 100.0 |

This pyrolysis gasoline cut is treated according to the process layout described in FIG. 1.

Catalyst and Operating Conditions of the First Hydrotreatment Stage HD1

The catalyst used for stage HD1 consists of 0.3 wt. % palladium deposited on a porous alumina support. The catalyst is arranged in two beds in a reactor with a device allowing to inject a fluid notably intended to cool the reaction mixture between the two beds.

The operating conditions are as follows:

Reactor outlet temperature: 110° C.

Reactor outlet pressure: 3.0 MPa

Hourly space velocity: 2.4 $h^{-1}$.

Hydrogen ratio (total gas at reactor inlet): 90 $Nm^3$ hydrogen per $m^3$ feed.

The product thus hydrotreated is distilled in order to separate the C5, C6-C8 and C9+ fractions.

The C9+ fraction referred to as fraction β has the following characteristics:

ASTM distillation range: 145° C.-218° C.

Density: 0.9

Sulfur content: 300 ppm weight

Aromatics content: 58 wt. %, including 1.0 wt. % diaromatics

Mono-olefins+paraffins+naphthenes content: 37 wt. %

Diolefins+alkenyl aromatics content: 5 wt. %.

Catalyst and Operating Conditions of the Alkylation Stage

The catalyst used for the alkylation stage is the TA801 acid catalyst marketed by the Axens Company. The catalyst is arranged in a single bed.

The operating conditions are as follows:

Reactor inlet temperature: 80° C.

Reactor outlet pressure: 3.0 MPa

Hourly space velocity: 0.25 $h^{-1}$.

The product thus recovered and referred to as gasoline γ has the following characteristics:

ASTM distillation range: 145° C.-285° C.

Density: 0.92

Sulfur content: 300 ppm weight

Aromatics content: 57 wt. %, including 1% diaromatics

Olefins content: 33 wt. %.

Gasoline γ is then distilled in order to recover a first light fraction γ1 whose boiling range corresponds to the gasoline cut, and a heavy fraction γ2.

The characteristics of gasoline γ1 are as follows:

ASTM distillation range: 145° C.-220° C.

Density: 0.9

Sulfur content: 46 ppm weight

Aromatics content: 58 wt. %, including 1% diaromatics

Olefins content: 27 wt. %.

The end point of gasoline γ1 can be adjusted according to the gasoline specifications of each country.

The characteristics of gasoline γ2 are as follows:

ASTM distillation range: 220° C.-285° C.

Sulfur content: 1300 ppm weight.

Gasoline γ1 can be incorporated directly to the low-sulfur gasoline pool.

Gasoline γ2 can be used as furnace fuel oil.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The preceding examples can be repeated with similar success by substituting the generically or specifically described reactants and/or operating conditions of this invention for those used in the preceding examples.

The entire disclosures of all applications, patents and publications, cited herein and of corresponding French application Ser. No. 07/01896, filed Mar. 14, 2007 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method for treating a hydrocarbon steam cracking effluent corresponding to a cut having a boiling point temperature ranging between 0° C. and 250° C., comprising:

a) at least one stage of selective hydrogenation of the feed, referred to as HD1, so as to hydrogenate diolefins, acetylenes, and alkenyl aromatics, b) fractionating in one or more distillation columns the effluent from stage a) in order to produce at least one light C5 cut containing mono-olefins, an intermediate C6 or C6-C7 or C6-C8 cut intended for aromatics production, and a heavy C7+ or C8+ or C9+ cut intended for gasoline production and containing alkylthiophenes, c) at least one stage of hydrodesulfurization and deep hydrogenation of the intermediate cut, referred to as HD2, d) at least one stage of alkylation of the heavy C7+, C8+ or C9+ cut with mono-olefins so as to further alkylate the alkyl thiophenes, thereby increasing molecular weight and facilitating separation thereof, and wherein a fraction of the light C5 cut containing mono-olefins is injected into the heavy C7+, C8+ or C9+ cut for said alkylation stage, said stage being operated at a temperature that ranges between 30° C. and 300° C., a hourly space velocity that ranges between 0.05 $h^{-1}$ and 5 $h^{-1}$, and a pressure that ranges between 1.0 MPa and 4.0 MPa, wherein the stage of alkylation consists essentially of a treatment on a solid acid catalyst selected from the group consisting of acid ion-exchanging resins, zeolites, clays, functionalized silicas, silico-aluminates with an acidity and grafted supports of acid functional groups, e) at least one stage of distillation of the effluent from stage d), intended to produce a light fraction that can be directly used as a low-sulfur gasoline base, and a heavy C11+ or C12+ fraction rich in sulfur compounds, used as middle distillate or fuel oil.

2. A method as claimed in claim 1, wherein the catalyst is selected from the group made up of acid ion-exchanging resins.

3. A method as claimed in claim 1, wherein alkylation stage d) is carried out in several reactors operated in series or in parallel.

4. A method as claimed in claim 3, wherein alkylation stage d) is carried out in two identical reactors connected to one another, one being in operation while the other is stopped and loaded with fresh catalyst ready for use.

5. A method as claimed in claim 3, wherein a fraction of the effluents of alkylation stage d) is recycled to the inlet of the alkylation reactors.

6. A method as claimed in claim 2, wherein the catalyst is used in an expanded bed.

7. A method as claimed in claim 3, wherein a catalyst addition/withdrawal system is added to the reactors of stage d) in order to continuously withdraw used catalyst and to have fresh catalyst make-up.

8. A method as claimed in claim 1, wherein the catalyst(s) used for stage d) are subjected to a rejuvenation treatment either in the reactor when it is isolated from the circuit or outside the reactor when an addition/withdrawal system is provided.

9. A method according to claim 1, wherein said alkyl thiophenes recovered from the fractionating in step (b) contain alkyl groups of 1-4 carbon atoms.

10. A method according to claim 9, wherein said alkyl thiophenes comprise at least one of ethyl thiophene, dimethyl thiophene, propyl thiophene and butyl thiophene.

11. A method according to claim 10, wherein said monoolefins in step (d) comprise 7 carbon atoms or more and optionally butenes or pentenes.

12. A method according to claim 9, wherein said monoolefins in step (d) comprise 7 carbon atoms or more and optionally butenes or pentenes.

13. A method according to claim 11, wherein said monoolefins also comprise butenes or pentenes.

14. A method according to claim 12, wherein said monoolefins also comprise butenes or pentenes.

* * * * *